United States Patent [19]

Roccaforte

[11] 4,373,626

[45] Feb. 15, 1983

[54] CARTON FOR CARDED PRODUCT

[75] Inventor: Harry I. Roccaforte, Western Springs, Ill.

[73] Assignee: Champion International Corporation, Stamford, Conn.

[21] Appl. No.: 155,439

[22] Filed: Jun. 2, 1980

[51] Int. Cl.[3] ..... B65D 81/00; B65D 25/54; B65D 85/30

[52] U.S. Cl. ..... 206/45.14; 206/45.31; 206/45.19; 206/491; 206/588

[58] Field of Search ..... 206/45.14, 45.19, 45.31, 206/526, 525, 527, 491, 321, 457, 449, 454, 588, 591, 592; 220/445, 446, 447; 229/40

[56] References Cited

U.S. PATENT DOCUMENTS

| | | | |
|---|---|---|---|
| 1,957,256 | 5/1934 | Frey | 206/457 |
| 2,915,218 | 12/1959 | Rosenman et al. | 206/449 |
| 3,184,136 | 5/1965 | Forbes, Jr. | 206/588 |
| 3,211,282 | 10/1965 | Hennessey | 206/491 |
| 3,239,127 | 3/1966 | Spencer | 206/521 |
| 3,604,560 | 9/1971 | Farquhar | 206/491 |
| 3,696,918 | 10/1972 | Lerner | 206/526 |
| 3,866,745 | 2/1975 | Dlugopolski | 206/321 |

*Primary Examiner*—William T. Dixson, Jr.
*Attorney, Agent, or Firm*—Evelyn M. Sommer

[57] ABSTRACT

A rectangular carton has centering structure to hold a carded product away from the front and back panels of the carton. The carton has end closure panels hinged to the front and back panels and end closure flaps hinged to side panels for closure on a standard carton forming machine of the seal end type. The end closure panels on the back panel have end support flaps folded and secured back in angular engagement with the back panel behind the card. The end closure flaps on the side panels have tap extensions folded back for angular engagement with the side panels in front of the card. The folded back card centering portions cam into place to hold the card away from the front and back panels of the carton during the final end closing and sealing operation.

11 Claims, 7 Drawing Figures

CARTON FOR CARDED PRODUCT

BACKGROUND OF THE INVENTION

This invention relates to an improved carton for display of carded fragile consumer products and more particularly for the point of purchase display of cosmetics and notions such as eyebrow pencils, lipsticks or sunglasses and the like which are mounted on cards.

Some carded products are so fragile that it is necessary for them to be suspended inside the carton away from the carton forming walls. One prior method of suspending a carded product in a carton involves adding folding wings to the card edges to center the card and to keep the product spaced from the front and back panels of the carton. A problem of this method is that it is very difficult to accomplish mechanically on existing carton machines.

Another method of suspending a carded product in a carton away from the carton walls is to place the card diagonally inside the carton between opposite corners. Where point of purchase display of the goods through a window in a front panel of a carton is desired, however, the product is not ideally set for consumer viewing since one side edge of the card is close to the front panel of the carton and the other side edge is close to the back panel of the carton.

Other methods of suspending a fragile carded product for display in a windowed carton would require extensive and complicated machinery modifications which are not warranted, for example, when the product is being produced for the first time for market trial.

SUMMARY OF THE INVENTION

The display carton of the present invention provides an improved supportive means to protect a carded product. It has two principal advantages. First, it accommodates a simple planar card with a product mounted thereon. Second, the procedure for producing the carton is simple and it may be performed on a standard carton former of the seal end type. This is possible because the supporting means within the carton are formed as the carton flaps are being folded in their normal sequence.

Rectangular cartons normally have front and back panels with side panels therebetween. The front and the back panels each have a pair of end closure panels hinged thereto. The side panels each have a pair of end closure flaps hinged thereto. In a standard carton former of the seal end type used to form the carton of the invention the folding sequence of the scored and preglued carton is: the end closure flaps attached to the side walls first; and, the end closure panels attached to the front and back panels thereafter.

The standard carton forming sequence is preserved by the structure of the carton of the invention for supporting a carded product in which the carton includes: a substantially planar back face panel, a first side wall panel hinged to a first side edge of said panel; a front face panel hinged to said first side wall panel along the edge thereof opposite said back face panel, said front face panel extending substantially parallel to said back face panel and being substantially identical in size and shape to said back face panel; a second side wall panel hinged to the side edge of said front face panel opposite said first side wall panel; said second side wall panel hinged to the side edge of said back face panel opposite the first side edge thereof; a first pair of end closure panels, one each hinged at opposite ends of said back face panel; a second pair of end closure panels, one each hinged at opposite ends of said front face panel; a first pair of end closure flaps, one each hinged at opposite ends of said first side wall; a second pair of end closure flaps, one each hinged at opposite ends of said second side wall; a pair of end support flaps, one each hinged to and folded back on the adjacent end closure panel of one of said pairs of end closure panels, said end support flaps extending inwardly and angularly engaging the face panel to which its respective adjacent end closure panel is hinged; and tab means on said end closure flaps at each carton end to maintain the card end at that carton end spaced from said face panel opposite the face panel in engagement with the end support flap at that carton end.

Before the standard carton folding sequence is begun, the pair of end support flaps and the two pairs of tabs hinged on the end closure flaps are provided with adhesive in a standard adhesive strip applying operation. This is in addition to the normal glue flap and end closure panel and flap adhesive applying operation. The end support flaps in the preferred embodiment of the formed and erected carton keep the card away from the back face panel and the tab means on the end closure flaps keep the card spaced from a windowed front face panel.

The end support flaps and tab means are each prefolded and glued back on the end closure panel member or end flap to which it is hinged prior to beginning the normal folding sequence of the end closure panels and flaps. When the normal folding sequence is performed with the thus pre-folded and pre-glued blank, the tabs on the end closure flaps will automatically cam along the adjacent side walls into angular engagement therewith to form diagonal supports that will prevent the card from coming close to the front face of the package. In a like manner, the end support flaps hinged to the end closure panels of the back face panel will automatically cam along the back face panel into angular engagement therewith and move the card toward the already positioned diagonally extending tabs when the end closure panels to which they are attached are folded into carton closed and sealed position.

BRIEF DESCRIPTION OF THE DRAWINGS

The invention will become better understood from the following detailed description, especially when read in light of the attached drawings, wherein.

DETAILED DESCRIPTION OF THE INVENTION

Figure 1:
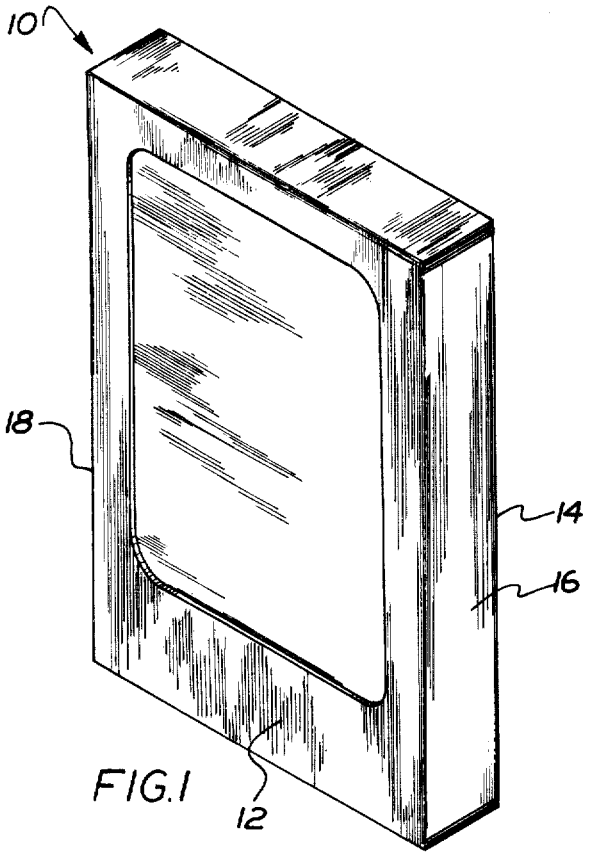
FIG. 1 is a perspective view of a preferred embodiment of the invention showing a display window in the front face panel of the carton.

The numeral 10 generally designates a carton for supporting a card with a product mounted on a face thereof constructed according to the principles of the invention. The carton 10 has a substantially planar front face panel 12 and a substantially planar back face panel 14 extending substantially parallel to the front panel 12 and being substantially identical in size and shape to the front panel.

Between the front face panel 12 and the back face panel 14 are a first side wall panel 16 and a second side wall panel 18. The front face panel 12 is hinged to the first side wall panel 16 by fold line 20 along one side edge thereof and is hinged to second side wall 18 by means of a second fold line 22 along the side edge opposite fold line 20. The back face panel 14 is hinged to the second side wall 18 by means of fold line 24 along one side edge thereof and is hinged by means of a fold line 26 along the opposite side edge thereof to a glue flap 28. The glue flap 28 creates a hinge between the back face panel 14 and the first side wall panel 16 when the carton is formed and erected since the glue flap 28 is adhesively attached to the inside margin of the first side wall 16 adjacent its free edge 30.

Figure 2:
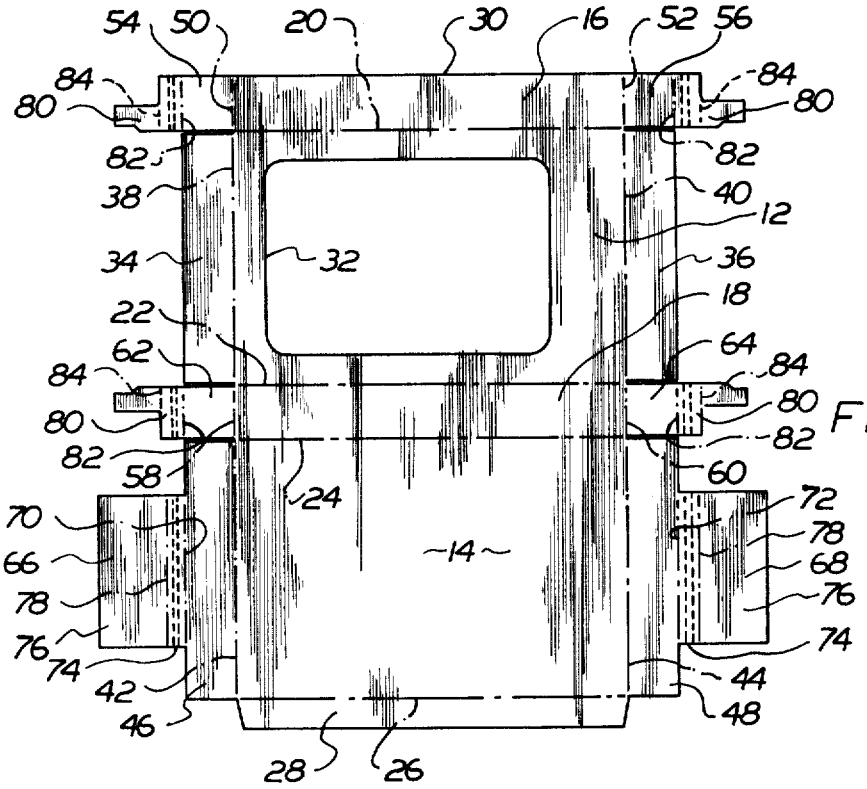
FIG. 2 is a plan view of the carton blank from which the carton as shown in FIG. 1 can be formed.

The front face panel 12 is provided with a display window 32 in the preferred embodiment illustrated in FIGS. 1 and 2. At the opposite ends of the front face panel 12, a pair of end closure panels 34 and 36 are hingedly provided by means of fold lines 38 and 40, respectively. Hinged to the opposite ends of back face panel 14 by means of fold lines 42 and 44 are end closure panels 46 and 48, respectively. Hinged at the opposite ends of first side wall panel 16, by means of fold lines 50 and 52 are end closure flaps 54 and 56, respectively. Hinged to the second side wall panel 18 by means of fold lines 58 and 60 are end closure flaps 62 and 64, respectively.

The carton as described thus far is a normal rectangular carton of the prior art of a type which may be formed on a standard seal end type carton forming machine. In order to accomplish the advantages of the invention the additional structure to be described is added to that already set forth in a manner which still permits the standard carton formng seal end type machine to be utilized to produce the carton.

Figure 4:
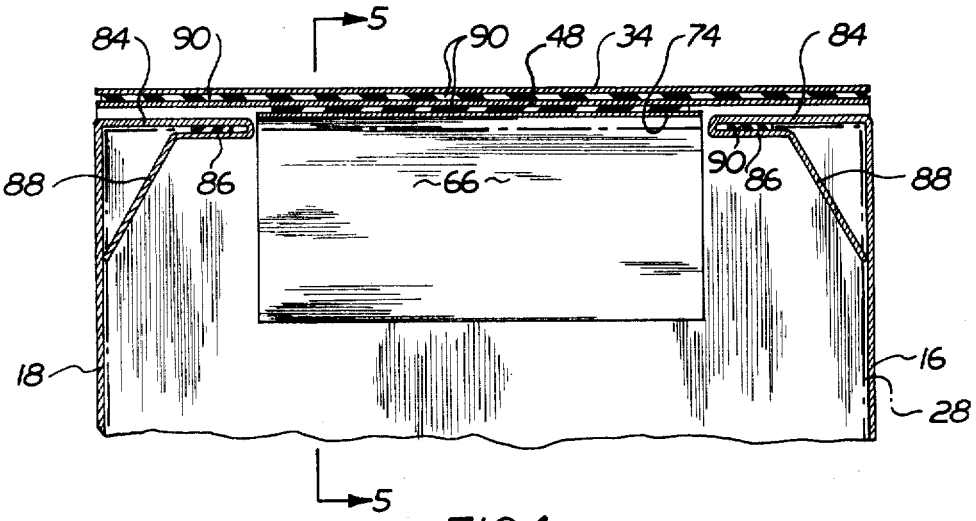
FIG. 4 is a fragmentary cross-sectional elevational view with the front face panel of a carton removed.
Figure 5:
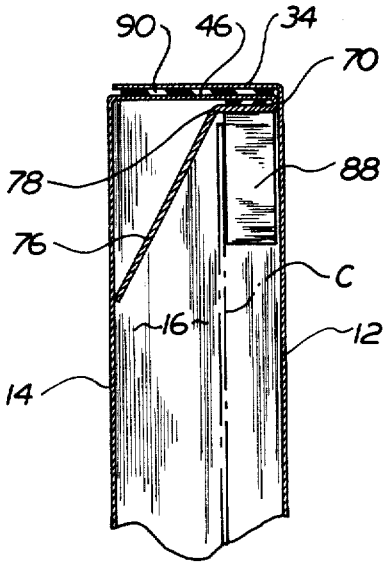
FIG. 5 is a cross-sectional elevational view taken along line 5—5 of FIG. 4.
Figure 6:
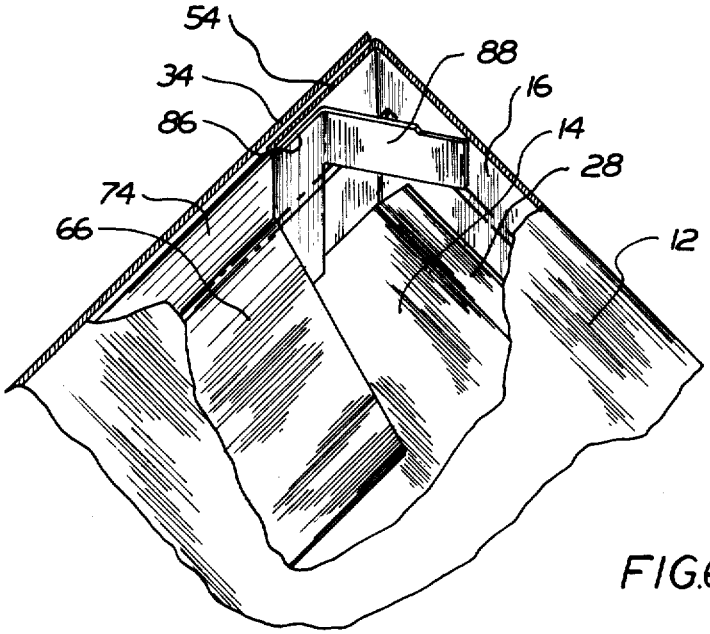
FIG. 6 is a fragmentary perspective view with a portion of the carton's front face panel broken away for clarity.
Figure 7:
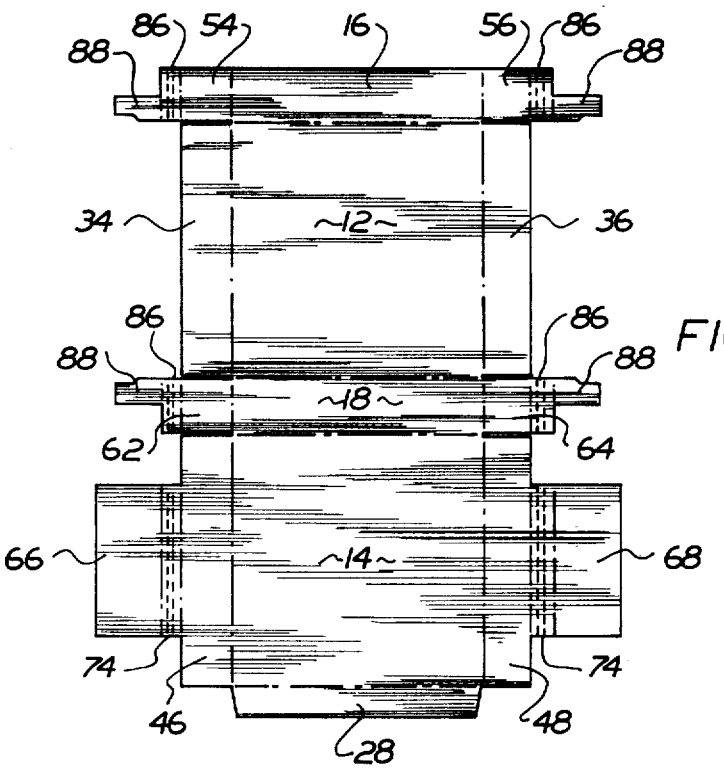
FIG. 7 is a view similar to FIG. 2 of an alternative carton without the display window in the front face panel.

In the carton 10 of the invention, at each end of the back face panel 14, the end closure panels 46 and 48 are provided with extensions in the form end support flaps 66 and 68, respectively. The end support flaps 66 and 68 are hinged to the adjacent end closure panels 46 and 48, respectively by means of fold lines 70 and 72. The end support flaps 66 and 68 are each made up of two panels 74 and 76 hinged together by a common fold line 78. The end closure flaps 54, 56, 62 and 64 of carton 10 each have tabs 80 attached thereto by fold lines 82. Each of the tabs 80 is connected to its respective end closure flap and is hinged about fold lines 84 to define two hinged tab portions 86 and 88 on either side of the fold line 84, as best seen in FIGS. 4 and 6. The tabs 80 are the means to maintain the card "C" spaced from the front face panel 12.

In producing the carton, a standard adhesive applying machine places adhesive on the panels 86 of the tabs 80 and the panels 74 of the end support flaps 66 and 68. This is in addition to the normally applied adhesive on the end closure panels 34 and 36, and the glue flap 28. The adhesive material 90 is well known in the art and is applied in a standard operation similar to a printing operation. The completed carton blank prior to folding has the various fold lines pre-scored and the adhesive material 90 applied thereto.

The folding sequence to form the carton 10 is performed automatically. In the case of the preferred embodiment illustrated, the fold lines 70 and 72 and hinge lines 78 of the end support flaps 66 and 68 are perforated to permit a first fold about fold lines 70 and 72 to fold the end support flaps 66 and 68 back upon end closure panels 46 and 48 to which they are hingedly attached. A second fold is then performed in which the tabs 80, which are hingedly attached by means of perforated fold lines 82 to the end closure flaps 62 and 64, and folded back upon their respective end closure flaps. A third fold, folding back the tabs 80 on the ends of end closure flaps 54 and 56 is subsequently performed. These simple preliminary folds can be accommodated on the standard carton forming machine as a prelude to the normal rectangular box folding operations. Their effect is to seal each tab portion 86 to its respective adjacent end closure flap and to seal each of the end support flap panels 74 to its respective end closure panel so that they are ready to be cammed into final position.

With the blank of carton 10 thus prepared, the normal folding sequence of the carton forming operation is performed wherein the end closure flaps are folded inwardly at right angles to the side wall panels 16 and 18 to which they are attached. During this folding operation, the hinged tab portions 88 cam along the side walls 16 and 18, respectively to a point where they form a diagonal support between the hinged fold line 84 and the respective adjacent side wall in angular engagement therewith. The hinged portions 88 are narrower than the end closure flap to which the tab 80 is hinged and are located closer to the front face panel 12, for purposes that will be seen hereinafter.

Figure 3:
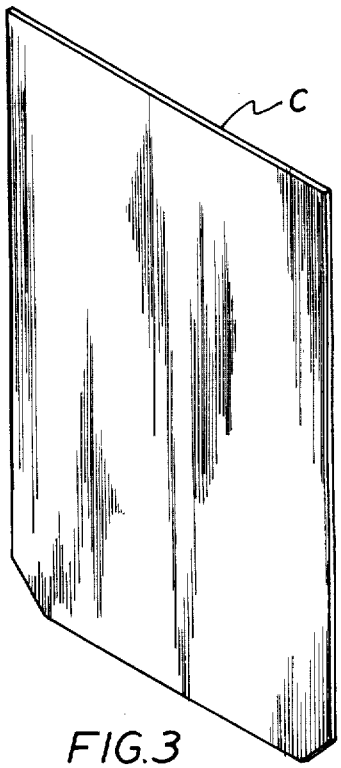
FIG. 3 is a perspective view of a card of the type which would have a fragile product mounted on its face for support within the carton of the invention.

The end support flaps 66 and 68 with their respective hinges 70 and 72 connecting them to the adjacent end closure panels 46, 48, have outer portions 76 hinged by means of perforated fold lines 78 engaging the back face panel 14. Since the folding and sealing of the end closure panels 34,36 and 46,48 is the final folding and sealing operation in the carton forming, the fragile product material on card "C" of FIG. 3 is placed in the carton just prior to this operation. Thus, as the portions 76 of the end support flaps 66 and 68 cam along the inner surface of the back face panel 14 the card "C" is cammed automatically into engagement with the four diagonal supports 88 which keep it from engagement with the front face panel 12. The card "C" is thus centered and held between the end support flap portions 76 and the diagonal tab portions 88 and the fragile product mounted on the face thereof will be suspended in the carton and thereby protected.

The above description is for the purpose of explaining the present invention to those skilled in the art but is not meant to include all of those obvious modifications and variations thereof which will become apparent by reading. It is intended, however, that all of such modifications and variations be included within the present invention, the scope of which is defined by the following claims.

What is claimed is:

1. A carton for supporting a card with a product mounted on a face thereof to space the product from the carton structure including:

a substantially planar back face panel;

a first side wall panel hinged to a first side edge of said back panel;

a front face panel hinged to said first side wall panel along the edge thereof opposite said back face panel, said front face panel extending substantially parallel to said back face panel and being substantially identical in size and shape to said back face panel;

a second side wall panel hinged to the side edge of said front face panel opposite said first side wall panel, said second side wall panel hinged to the side edge of said back face panel opposite the first side edge thereof;

a first pair of end closure panels, one each hinged at opposite ends of said back face panel;

a second pair of end closure panels, one hinged at opposite ends of said front face panel;

a first pair of end closure flaps, one each hinged at opposite ends of said first side wall;

a second pair of end closure flaps, one each hinged at opposite ends of said second side wall;

a pair of end support flaps, one each hinged to and folded back on the adjacent end closure panel of one of said pairs of end closure panels, said end support flaps extending inwardly and angularly engaging the face panel to which its respective adjacent end closure panel is hinged;

and means at each carton end to maintain the product and the card end at that carton end spaced from said face panel opposite the face panel in engagement with the end support flap at that carton end.

2. The carton of claim 1 in which the means at each carton end to maintain the card end at that end spaced from said face panel opposite the face panel in engagement with the end support flap at that carton end are located on said end closure flaps.

3. The carton of claim 1 in which the pair of end support flaps are hinged to a pair of end closure panels hinged to the same face panel.

4. The carton of claim 3 in which the face panel is the back panel.

5. The carton of claim 1 in which each of the end support flaps includes at least two hinged portions and one of said two hinged portions is adjacent, hinged to and folded back on an end closure panel and has adhesive which attaches it to that end closure panel.

6. The carton of claim 5 in which the other of said two hinged portions of each of the end support flaps is the portion of the end support flap which angularly engages the face panel to which its respective adjacent end closure panel is hinged.

7. The carton of claim 2 in which the means on said end closure flaps at each carton end to maintain the card end at that carton end spaced from said face panel opposite the face panel in engagement with said end support flap at that carton end are tabs hinged to the end closure flap adjacent thereto and engaging the carton side wall adjacent thereto.

8. The carton of claim 7 in which said tabs include at least two hinged tab portions, one tab portion of which is adjacent, hinged to and folded back on an end closure flap and which has adhesive which attaches it to that end closure flap.

9. The carton of claim 6 in which the means on said end closure flaps at each carton end to maintain the card end at that carton end spaced from said face panel opposite the face panel in engagement with said end support flap at that carton end are tabs hinged to the respective end closure flap adjacent thereto and engaging the carton side walls adjacent thereto, and each of said tabs includes a tab portion narrower than the end closure flap to which said tab is hinged and closer to said face panel opposite the face panel in engagement with said end support flap at that carton end than is the portion of said end support flap which angularly engages the face panel to which its respective adjacent end closure panel is hinged.

10. The carton of claim 4 in which said front face panel includes an opening for use as a product display window.

11. A blank for making a carton as described in claim 1.

* * * * *